US011291299B2

(12) United States Patent
Isgar

(10) Patent No.: US 11,291,299 B2
(45) Date of Patent: Apr. 5, 2022

(54) RETRACTABLE SELF-SANITIZING DIVIDER ASSEMBLY

(71) Applicant: Charles Isgar, Scottsdale, AZ (US)

(72) Inventor: Charles Isgar, Scottsdale, AZ (US)

( * ) Notice: Subject to any disclaimer, the term of this patent is extended or adjusted under 35 U.S.C. 154(b) by 0 days.

(21) Appl. No.: 17/201,861

(22) Filed: Mar. 15, 2021

(65) Prior Publication Data

US 2021/0345770 A1 Nov. 11, 2021

Related U.S. Application Data

(60) Provisional application No. 63/022,419, filed on May 8, 2020.

(51) Int. Cl.
*A47B 13/08* (2006.01)

(52) U.S. Cl.
CPC ..... *A47B 13/08* (2013.01); *A47B 2200/12* (2013.01)

(58) Field of Classification Search
CPC ..... A47B 57/00; A47B 57/58
USPC ..... 108/64, 60, 61, 67; 297/184.1, 184.11, 297/184.14, 184.15
See application file for complete search history.

(56) References Cited

U.S. PATENT DOCUMENTS 1,992,903 A * 2/1935 Potashnik ..... A47B 83/02 297/158.1
2,944,861 A * 7/1960 Lessin ..... A47B 17/02 312/196
3,083,417 A * 4/1963 Cook ..... A47B 41/00 52/64
3,117,534 A * 1/1964 Martland ..... A47B 41/00 108/60
3,117,535 A * 1/1964 Hendrickson ..... A47B 41/00 108/60
3,588,210 A * 6/1971 Des Marais ..... A47B 41/00 312/196
5,406,893 A * 4/1995 Burns ..... A47B 41/00 108/60
5,971,487 A * 10/1999 Passehl ..... B60N 2/28 297/464
6,062,147 A * 5/2000 Footitt ..... A47B 17/00 108/50.01
8,322,802 B2 * 12/2012 Boxenbaum ..... A47B 51/00 312/223.3
9,066,589 B2 * 6/2015 Battey ..... A47B 41/02
10,299,581 B2 * 5/2019 Keller ..... A47B 13/088
10,376,605 B1 * 8/2019 Majdali ..... A61L 2/10
10,390,611 B2 * 8/2019 Lee ..... A47B 13/088
10,836,291 B2 * 11/2020 Line ..... B60N 2/90
(Continued)

*Primary Examiner* — Jose V Chen
(74) *Attorney, Agent, or Firm* — Schmeiser, Olsen & Watts LLP

(57) ABSTRACT

A retractable self-sanitizing divider assembly is provided. The assembly includes a planar structure having a first surface and a second surface. The assembly also includes a housing having an interior volume with an opening on one side. The housing may be coupled to the planar structure. The assembly may include a divider moveable between a retracted position located within the housing and an extended position with a portion of the divider is extended through the opening of the housing. The assembly may also include a sanitization system coupled to the housing wherein the sanitization system automatically sanitizes the divider during movement of the divider between the retracted position and the extended position.

17 Claims, 18 Drawing Sheets

(56) References Cited

U.S. PATENT DOCUMENTS

| | | | | |
|---|---|---|---|---|
| 2007/0085389 | A1* | 4/2007 | Schurg | B64D 11/0644 297/184.1 |
| 2009/0219513 | A1* | 9/2009 | Shakespeare | G01N 33/182 356/51 |
| 2009/0246336 | A1* | 10/2009 | Burnett | A23L 3/3463 426/326 |
| 2014/0096314 | A1* | 4/2014 | Ferro | A47K 13/302 4/237 |
| 2014/0318423 | A1* | 10/2014 | Parshad | A47B 83/001 108/60 |
| 2016/0250362 | A1* | 9/2016 | Mackin | B60N 3/004 244/118.5 |
| 2017/0368220 | A1* | 12/2017 | Joshi | A61L 2/202 |
| 2018/0361002 | A1* | 12/2018 | Mastrocola | B64D 13/00 |
| 2021/0052090 | A1* | 2/2021 | Luker | A47G 11/007 |

* cited by examiner

RETRACTABLE SELF-SANITIZING DIVIDER ASSEMBLY

CROSS REFERENCE TO RELATED APPLICATION[S]

This application claims priority to U.S. Provisional Patent Application entitled "RETRACTABLE SELF-SANITIZING DIVDER ASSEMBLY," serial number 63/022,419 filed May 8, 2020, the disclosure of which is hereby incorporated entirely herein by reference.

BACKGROUND OF THE INVENTION

Technical Field

This invention relates generally to a divider for use on a desk or other shared surfaces, and more particularly to a retractable self-sanitizing divider assembly that has a divider that is moveable between a retracted position and an extended position.

State of the Art

Dividers are used for various purposes. Referring to FIG. 1, many workspaces, such as the desk of several computers, like at a computer lab in a university or an open workspace in a business lack dividers. Some solutions may be to provide to separate workspaces, dinner spaces or other types of spaces. These dividers are either formed as part of the surface structure or may be mounted to the structure. Each of these dividers suffer from the same issues. They each lack an ability to be removed without uninstalling and lack the ability to be easily sanitized or self-sanitized. The conventional way of cleaning or sanitizing these existing dividers is for a person to use cleaning products or the like in order to clean the surfaces. Additionally, the dividers are always present and there may be times when a divider is not needed or desired, and the conventional way to accomplish such is to uninstall it.

There is a need for an improved divider that can be moved between a retracted position and an extend position and reduces the time and effort for cleaning the divider.

SUMMARY OF THE INVENTION

The present invention relates to a retractable self-sanitizing divider assembly with a divider that is moveable between a retracted position and an extended position.

An embodiment may include a retractable self-sanitizing divider assembly comprising: a planar structure comprising a first surface and a second surface; a housing comprising an interior volume with an opening on one side of the housing providing access to the interior volume of the housing, wherein the housing is coupled to the planar structure; a divider coupled within the housing moveable between a retracted position and an extended position, wherein the retracted position the divider is located within the housing and the in the extended position, a portion of the divider is extended through the opening of the housing to extend away from the first surface of the planar structure; and a sanitization system coupled to the housing wherein the sanitization system automatically sanitizes the divider during movement of the divider between the retracted position and the extended position.

In embodiments, the divider may be spring loaded. In other embodiments, the divider is a manually moved between the retracted position and the extended position. In yet further embodiments, the divider comprises an actuator that is electrically operated to move the divider between the retracted position and the extended position. The divider may be a planar substrate. The housing may be an open box shape. The sanitization system may comprise a flexible substrate. Sanitizing solution may be retained in the flexible substrate. The sanitizing solution may be located adjacent the opening of the housing. The flexible substrate may be coupled to a cassette. The cassette may be removeably coupled to the housing. The cassette may be removeably coupled to the divider. Sanitizing solution may be incorporated into a spray device sprayed on the flexible substrate. The assembly may be coupled between seats. The assembly may be coupled to an armrest between the seats. The seats may be shared transportation seats. The seats may be venue seats.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
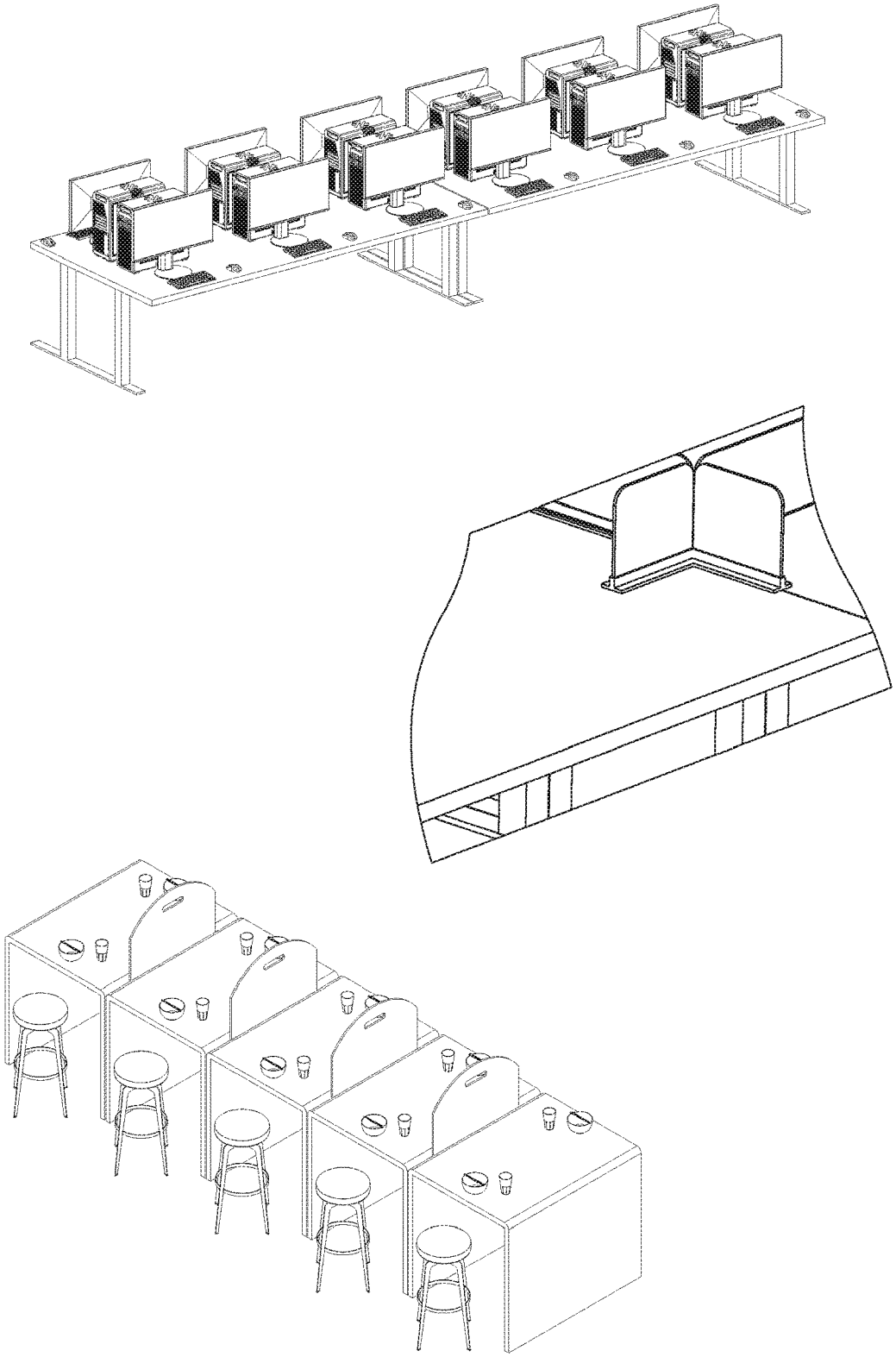
FIG. 1 (Prior Art)
FIG. 1 is a view of various prior art dividers.
Figure 2:
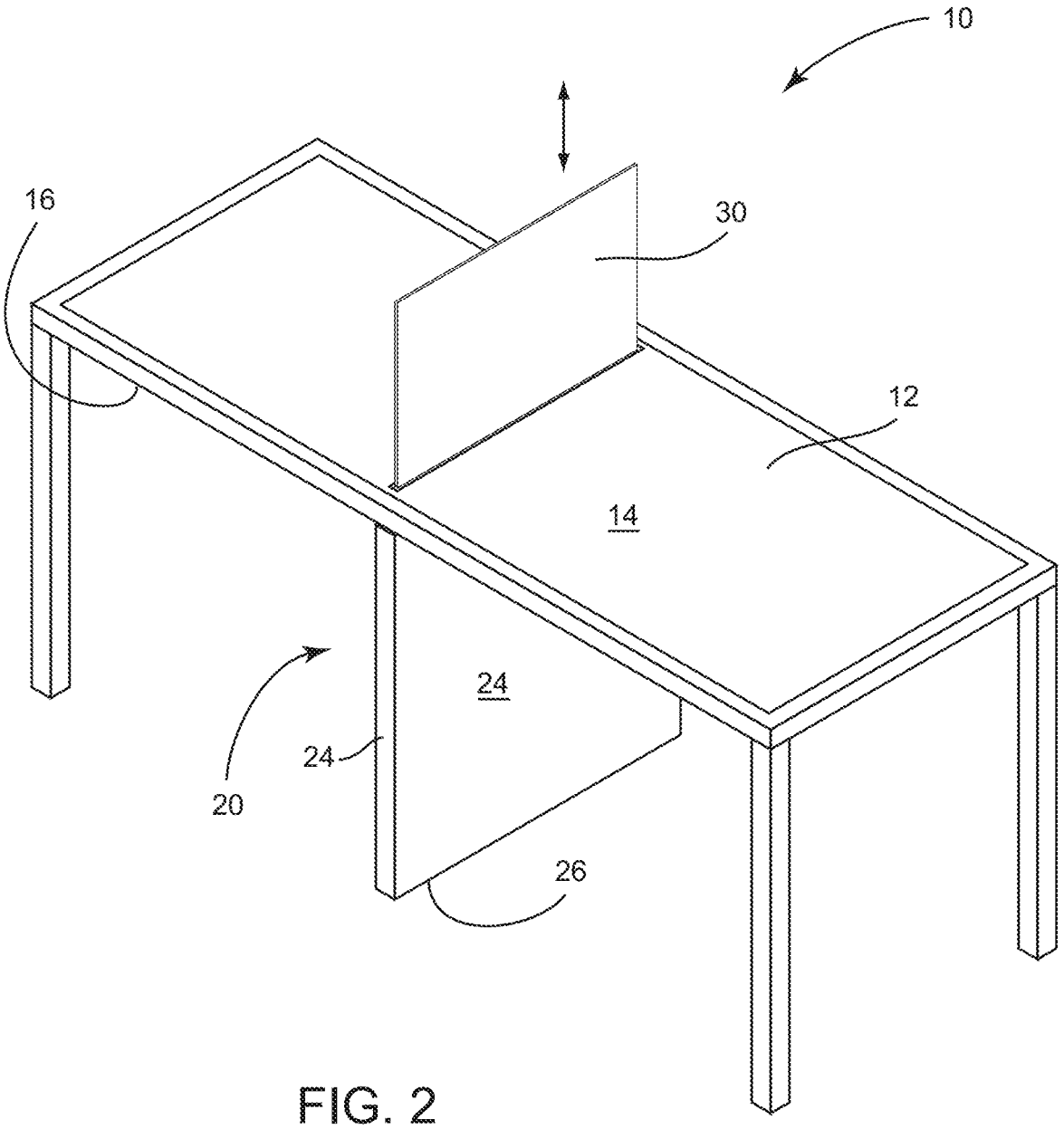
FIG. 2 is a perspective view of a table with a retractable self-sanitizing divider assembly coupled thereto with the divider in an extend position according to an embodiment.
Figure 3:
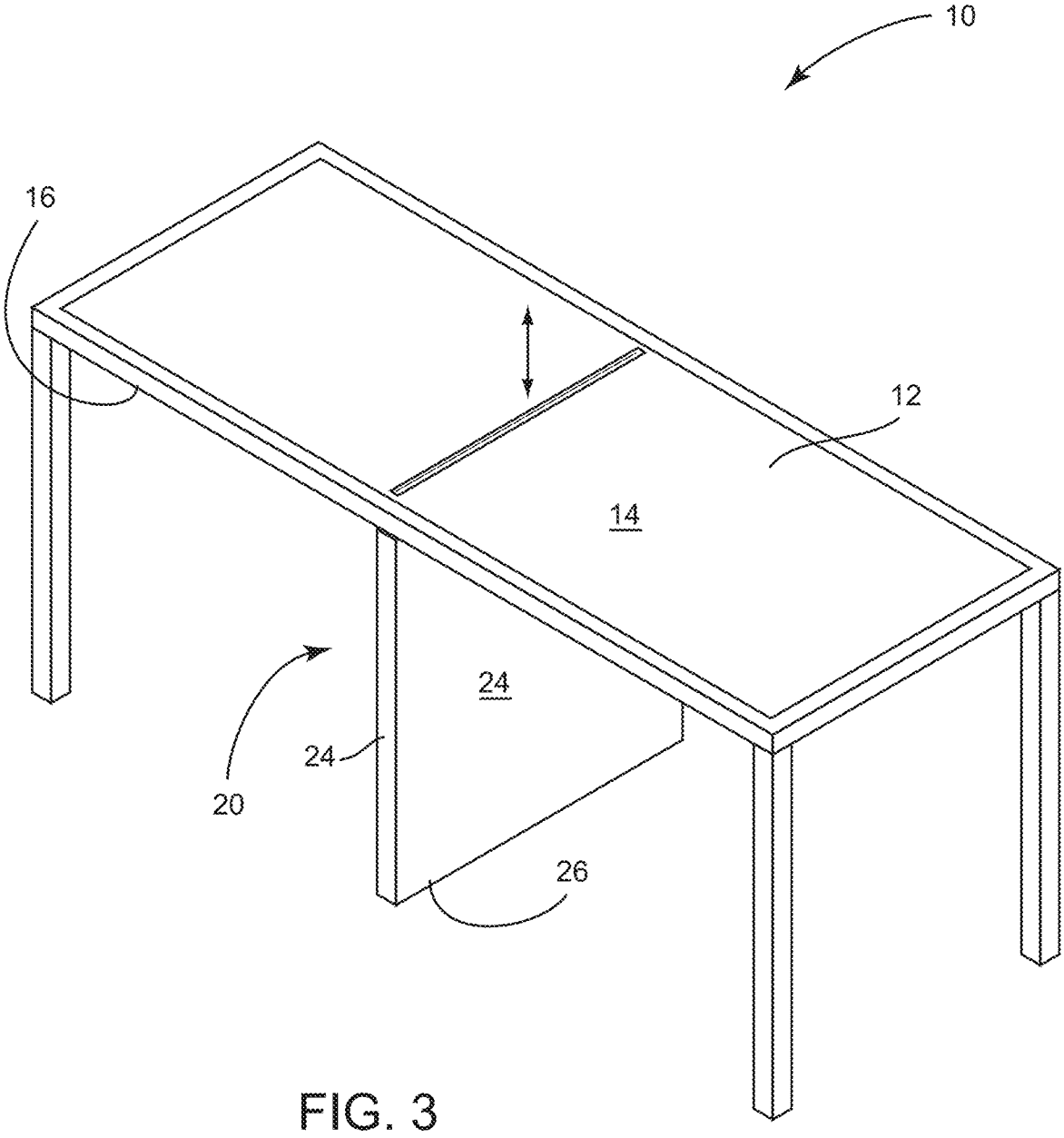
FIG. 3 is a perspective view of a table with a retractable self-sanitizing divider assembly coupled thereto with the divider in a retracted position according to an embodiment.

As discussed above, embodiments of the present invention relate to a retractable self-sanitizing divider assembly with a divider that is moveable between a retracted position and an extended position.

Referring to the drawings, FIGS. 2-5D depict an embodiment a retractable self-sanitizing divider assembly 10. The assembly 10 includes a planar structure 12, such as, but not limited to a desk to table structure (FIGS. 2-5D and 7A-7B), a wall (FIGS. 6A-6B), a chair (FIG. 8A-8B) or the like. As shown in FIGS. 2-5D, the planar structure 12 is a table or desk surface. The planar structure 12 may include a first surface 14, a second surface 16, and in some embodiments may include an aperture 18 extending through the planar structure 12.

The assembly 10 may also include a housing 20 that includes an interior volume 22. In embodiments, the housing 20 may be a rectangular prism shape or any shape that corresponds to the shape of a divider 30. For example, and without limitation, the housing 20 may include four side members 24 that are coupled together to form a rectilinear shape and a bottom member 26 coupled to one end of each of the four side members 24 to form an open box structure, wherein the housing including an opening 28.

In some embodiments, the housing 20 may be coupled to the planar structure 12 with the housing extending away from the second surface 16 of the planar structure 12 with the opening 28 of the housing 20 aligned with the aperture 18 of the planar structure 12, as shown in FIGS. 2-5D.

As depicted in FIGS. 2-5D, the assembly 10 may include a divider 30 that is moveable between a retracted position and an extended position. In the retracted position, the divider 30 is located within the housing 20 and the in the extended position, a portion of the divider 30 is extended through the opening 28 of the housing 20 and the aperture 18 of the planar structure 12 to extend away from the first surface 14 of the planar structure 12. The divider 30 in some embodiments may be planar substrate. Further, the divider 30 may be spring loaded with a locking device, wherein the spring 49 biases the divider 30 toward the extended position and the locking device temporarily locks the divider 30 in the retracted position. In embodiments, the divider is a manually moved between the retracted position and the extended position, such as applying a force to the divider in order to engage the spring loaded device or to manually push or pull on a handle 32 (see optional handle 32 in FIG. 4). In yet further embodiments, the divider 30 comprises an actuator 47 that is electrically operated to move the divider 30 between the retracted position and the extended position, such as by using a button 34 shown in FIG. 4 or by remotely activating the electric actuator.

Figure 4:
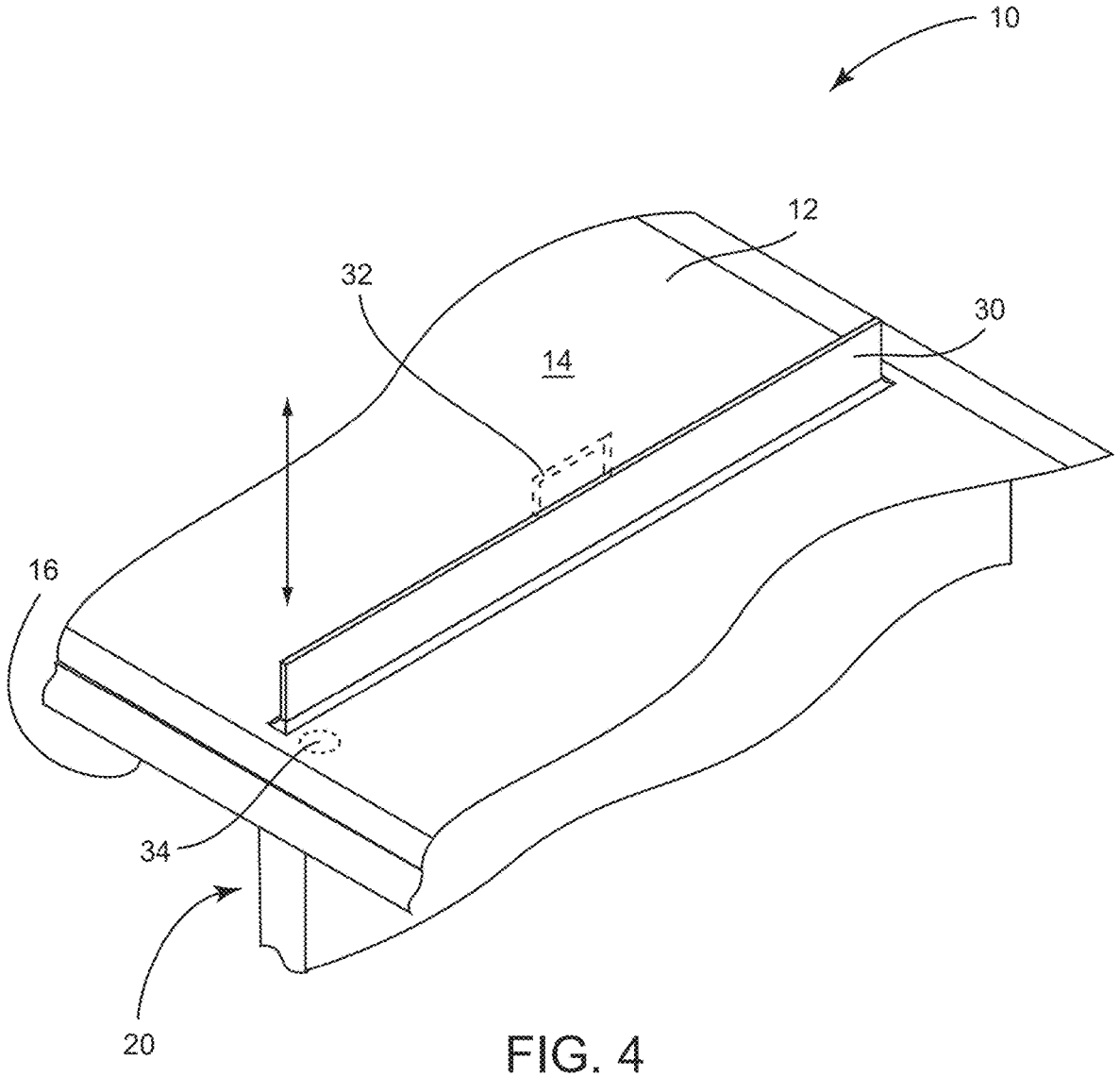
FIG. 4 is a close-up partial view of a table with a retractable self-sanitizing divider assembly coupled thereto moving between a retraced position and an extended position according to an embodiment.
Figure 5A:
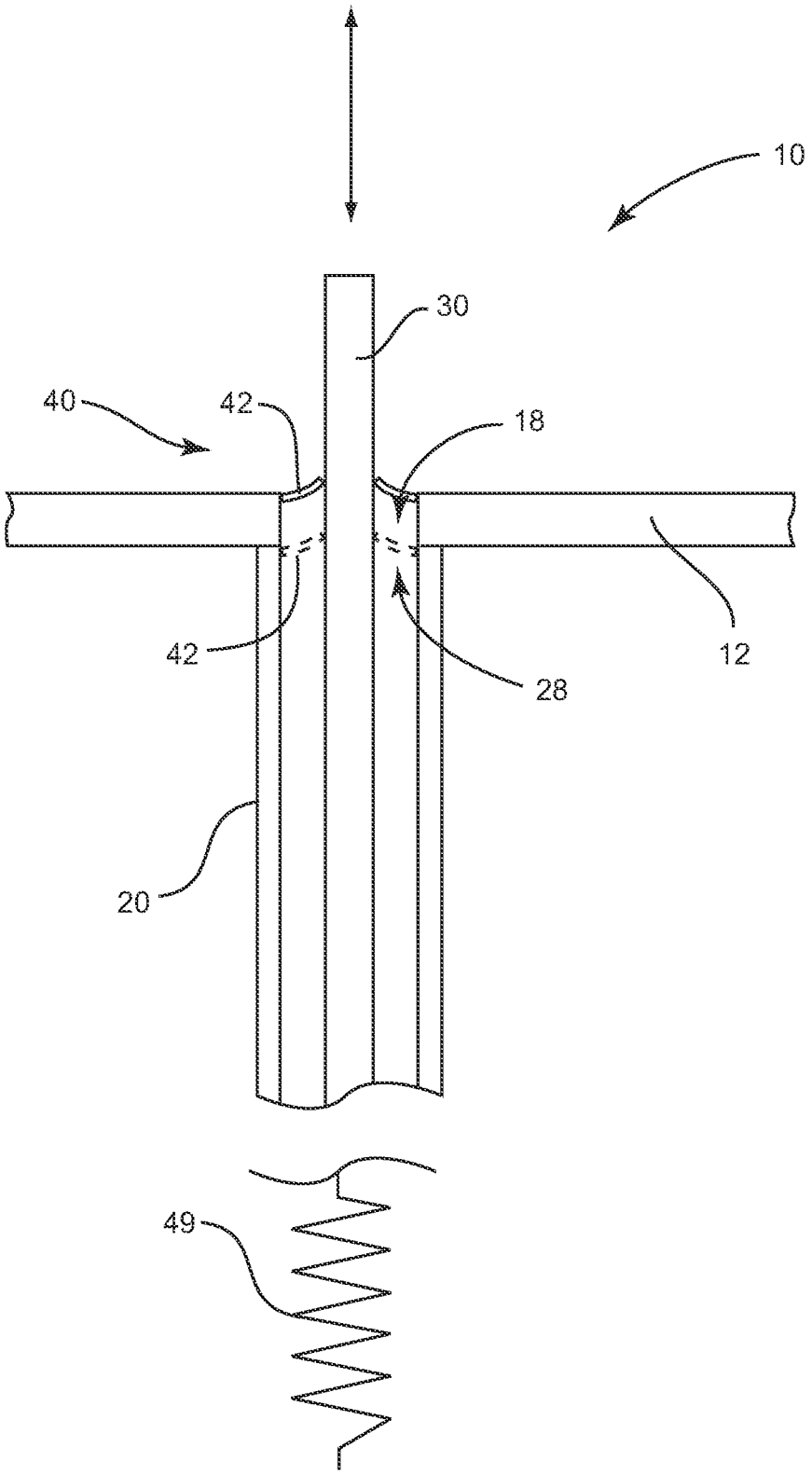
FIG. 5A is a section view of a table with a retractable self-sanitizing divider assembly coupled thereto moving between a retraced position and an extended position according to an embodiment.
Figure 5B:
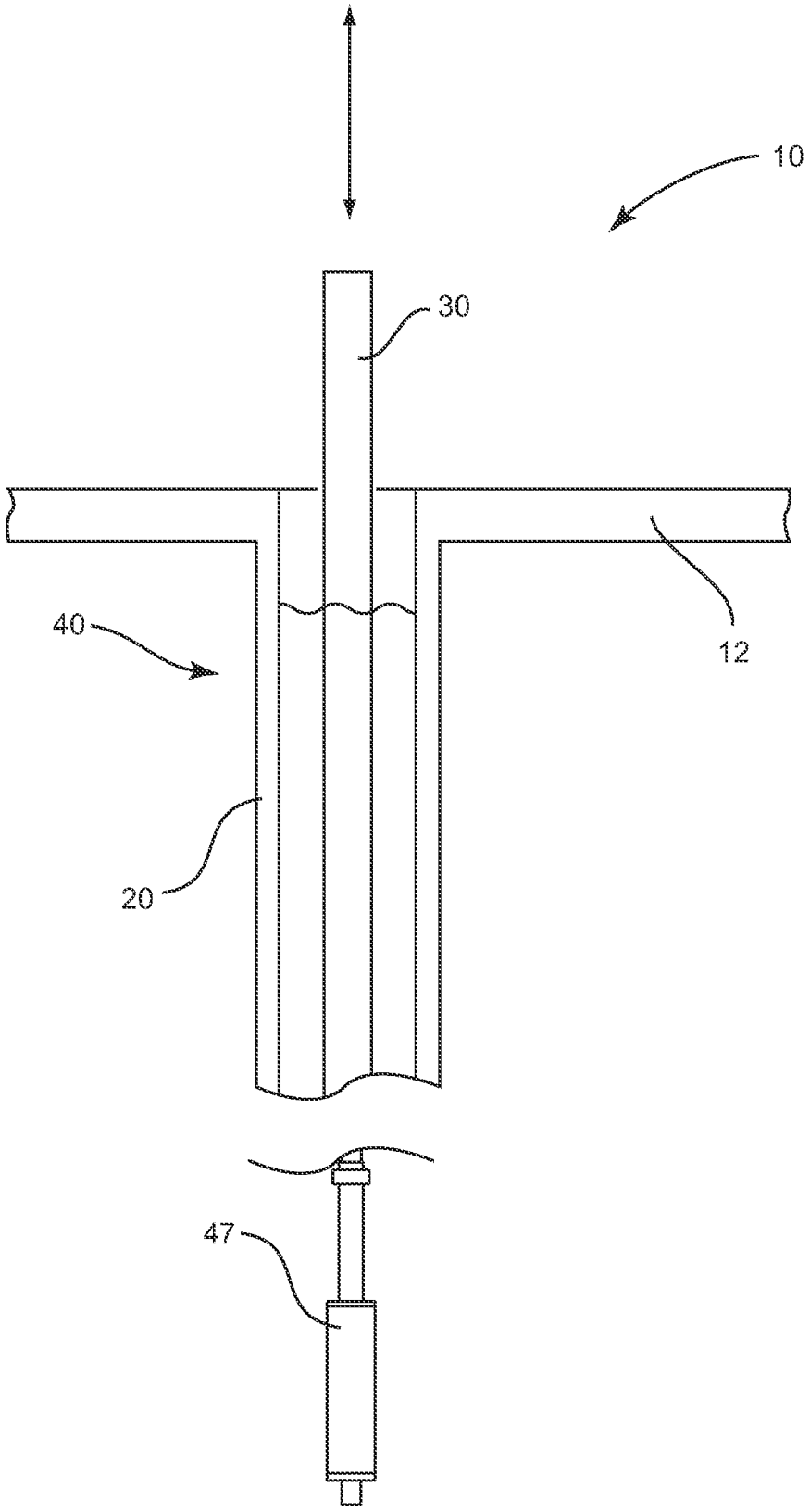
FIG. 5B is another section view of a table with a retractable self-sanitizing divider assembly coupled thereto moving between a retraced position and an extended position according to an embodiment.
Figure 5C:
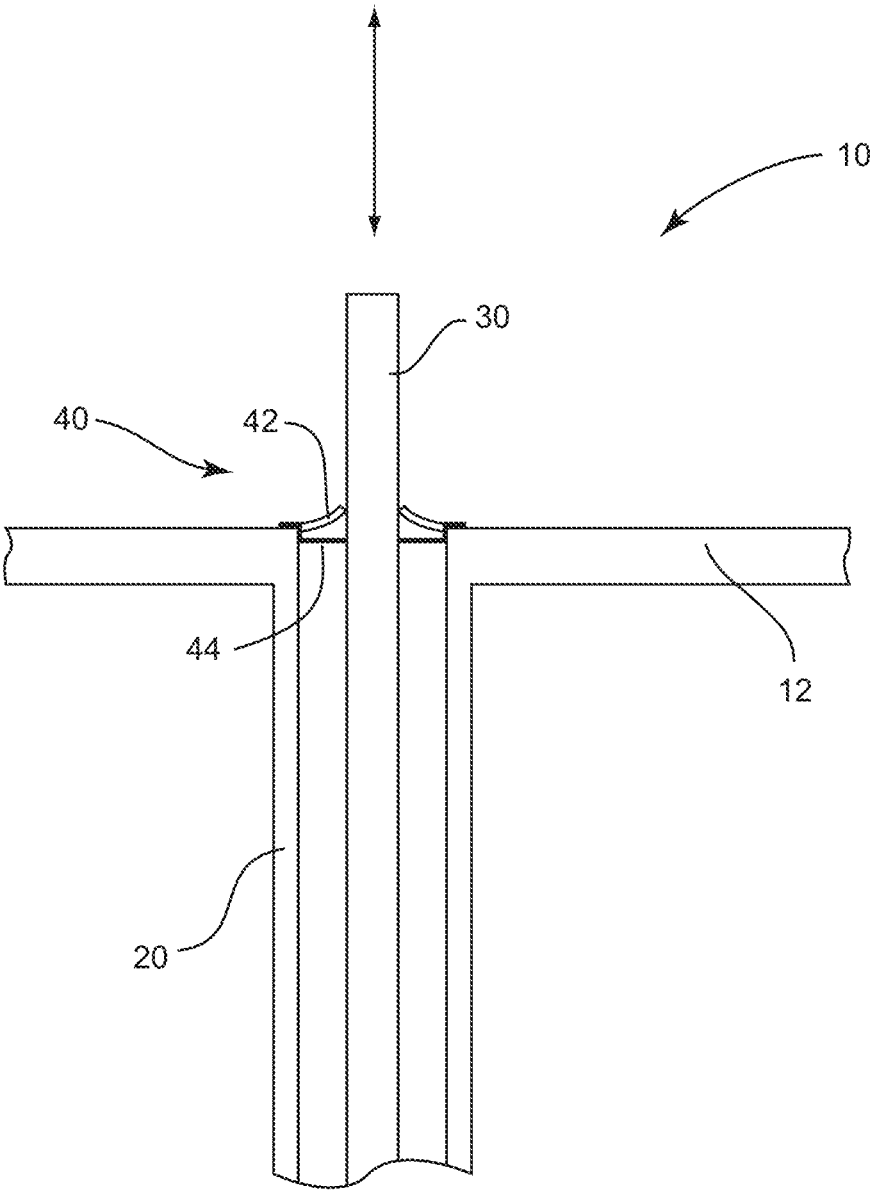
FIG. 5C is a section view of a table with a retractable self-sanitizing divider assembly coupled thereto moving between a retraced position and an extended position according to an embodiment.
Figure 5D:
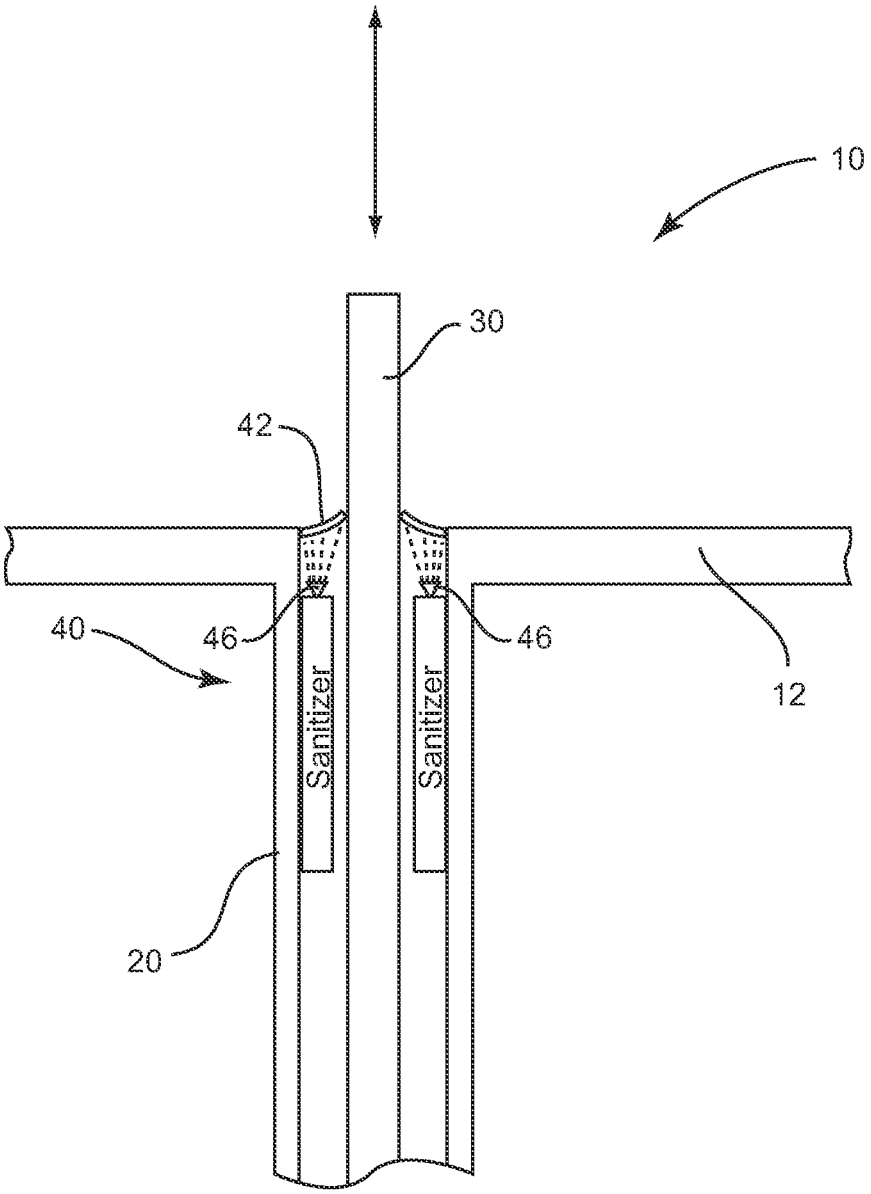
FIG. 5D is another section view of a table with a retractable self-sanitizing divider assembly coupled thereto moving between a retraced position and an extended position with sanitizing solution sprayed onto a flexible substrate according to an embodiment.
Figure 5E:
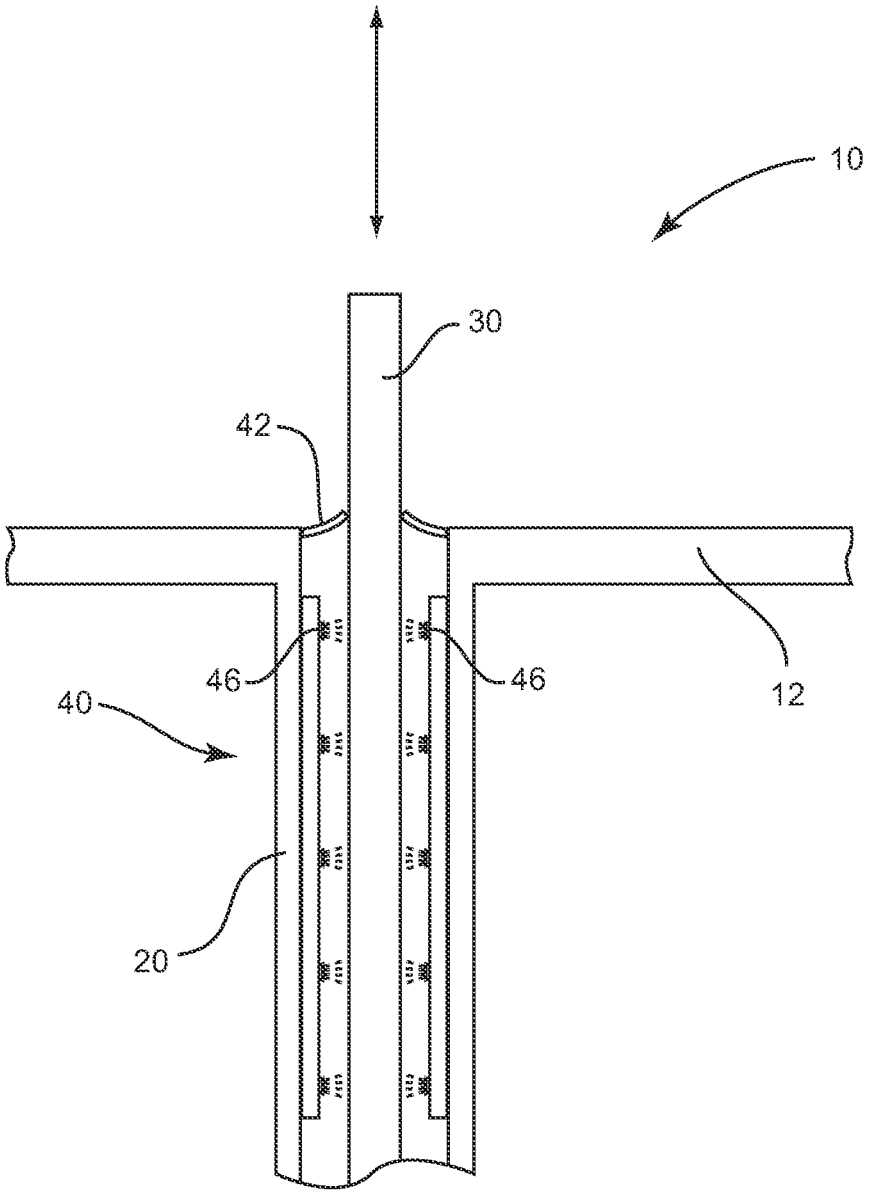
FIG. 5E is another section view of a table with a retractable self-sanitizing divider assembly coupled thereto moving between a retraced position and an extended position with sanitizing solution sprayed onto the divider according to an embodiment

As shown in FIGS. 2-5E, the assembly 10 may also include a sanitization system 40. The sanitization system 40 may include a flexible substrate 42 (see FIGS. 4, 5A, 5C, 5D and 5E). In embodiments, the sanitizing solution may be retained within the flexible substrate 42 and located in various positions adjacent the opening of the housing, as shown in FIGS. 4 and 5A. In another embodiment, the flexible substrate 42 may be coupled to a cassette 44, wherein the cassette 44 is removably coupled to the housing 20 or the planar structure 12 and sanitizing solution may be retained within the flexible substrate 42, as shown in FIG. 5C. The cassette 44 with the flexible substrate 42 may be replaced by removing and installing another in its place, wherein the replacement of the cassette 44 occurs when the flexible substrate 42 no longer retains sanitizing solution. In FIG. 5D, embodiments may include the sanitizing solution incorporated into a spray device 46 that sprays the flexible substrate 42 with sanitizing solution as the divider 30 moves between the retracted position and the extended position. In FIG. 5E, embodiments may include the sanitizing solution incorporated into a spray device 46 that sprays the divider 30 with sanitizing solution as it moves between the retracted position and the extended position. Another embodiment depicted in FIG. 5B, includes a sanitizing solution 44 retained within the housing 20, such that the divider 30 is immersed in the sanitizing solution 44 for sanitization purposes. In this embodiment with the sanitization solution retained within the housing 20, a flexible substrate 42 may be utilized and may operate as a squeegee to wipe off the sanitization solution as the divider 30 moves from the retracted position to the extended position.

Generally, suitable sanitizing solutions comprise disinfectants approved for use against COVID-19 on surfaces by the Environmental Protection Agency (EPA), such as hydrogen peroxide and the like. EPA List N: Disinfectants for Use Against SARS-CoV-2 lists disinfectants approved by the EPA and is hereby incorporated entirely herein by reference.

Figure 7A:
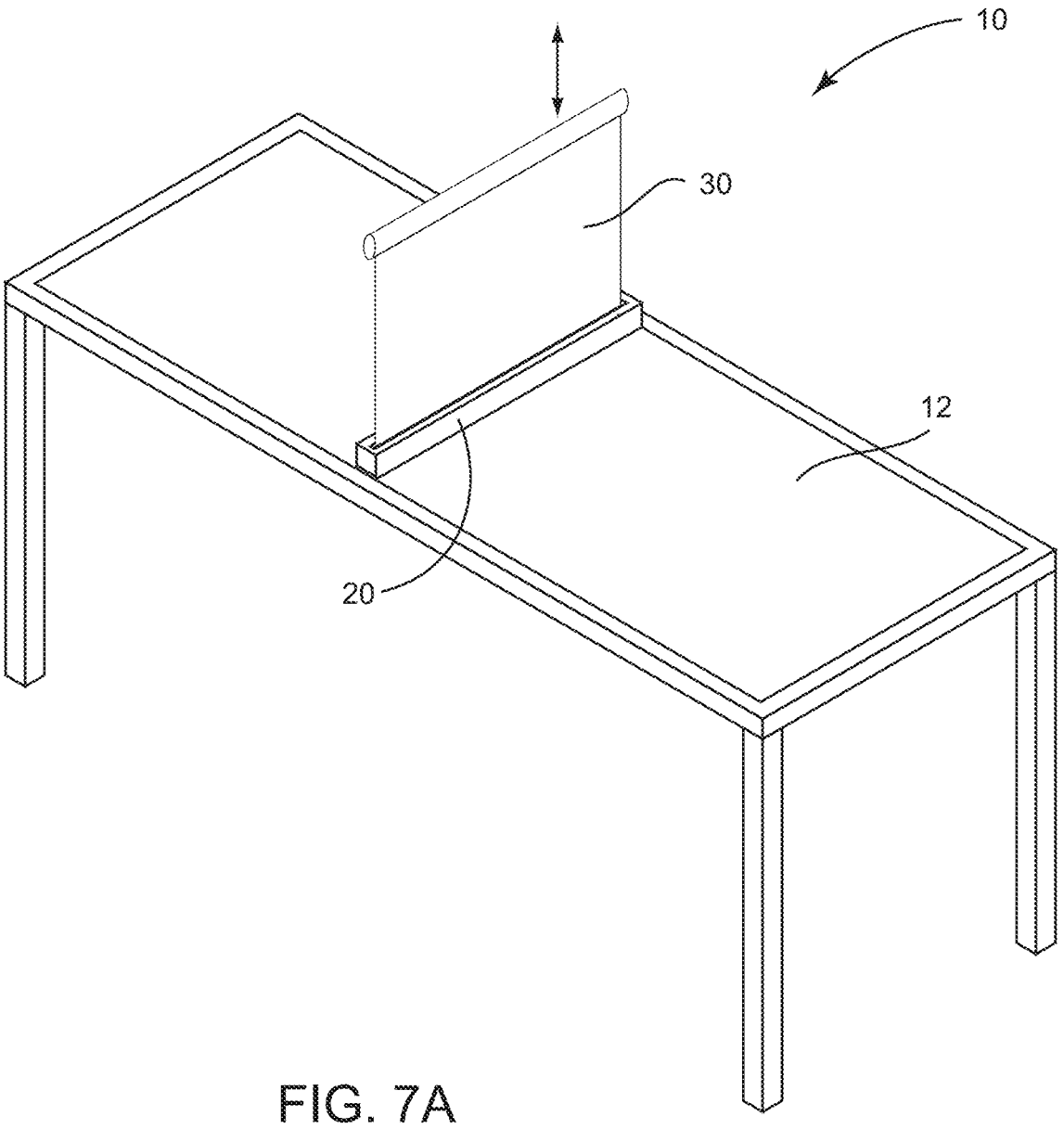
FIG. 7A is a perspective view of a table with a retractable self-sanitizing divider assembly coupled thereto with the divider in an extend position according to an embodiment.
Figure 7B:
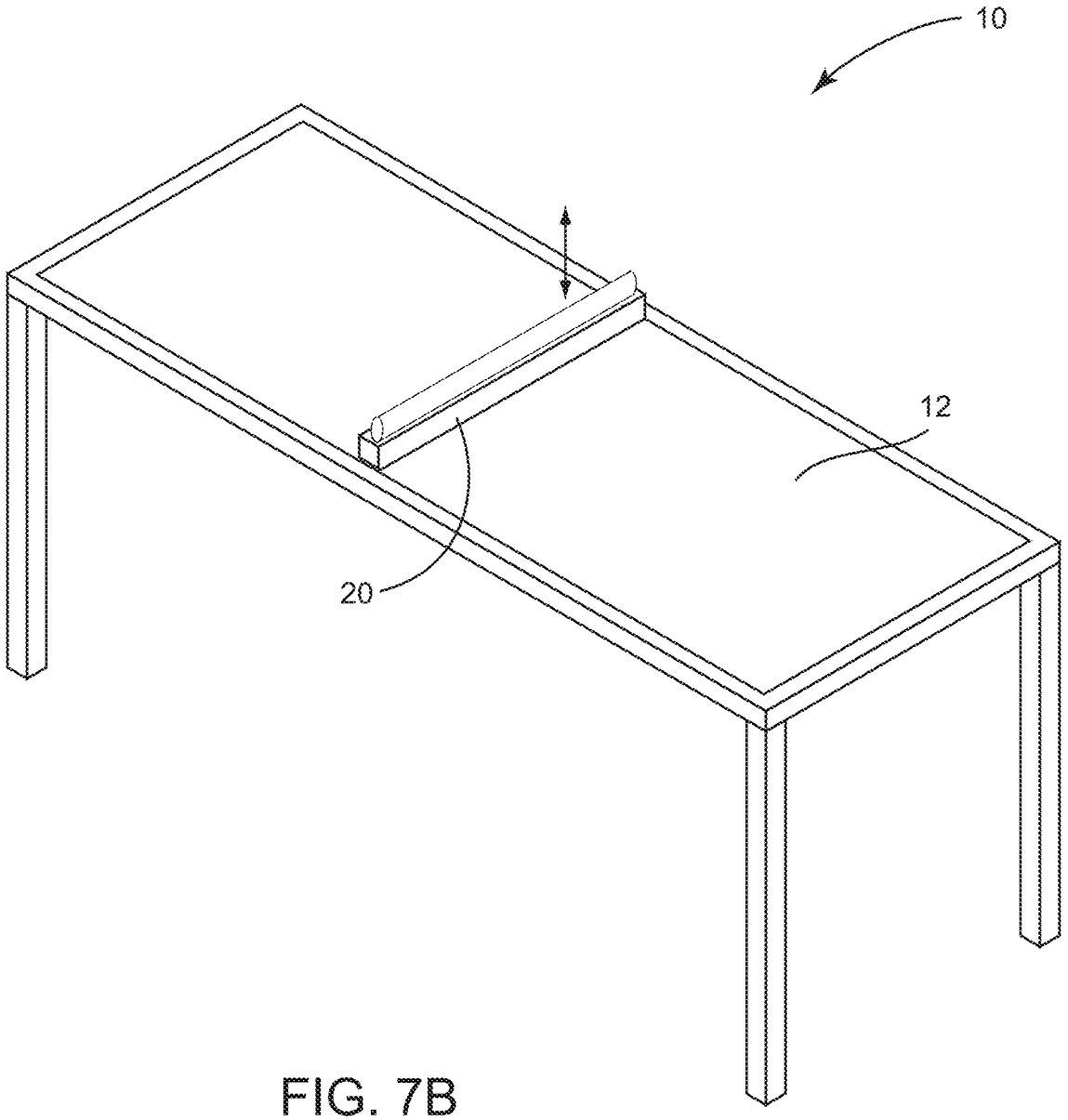
FIG. 7B is a perspective view of a table with a retractable self-sanitizing divider assembly coupled thereto with the divider in a retracted position according to an embodiment.
Figure 7C:
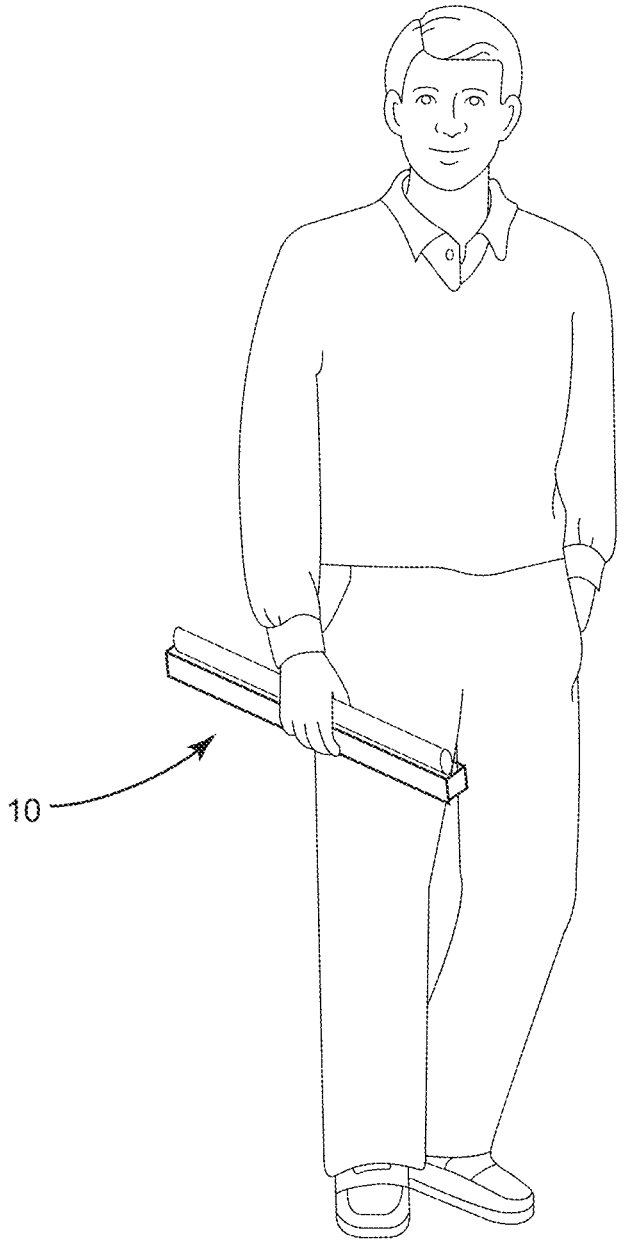
FIG. 7C is a perspective view of a person carrying a portable retractable self-sanitizing divider assembly according to an embodiment.

In other embodiments, as shown in FIGS. 7A-7C, the assembly 10 may include a housing 20 with a divider 30 that may be coupled to the first surface of the planar structure 12, and the assembly 10 may be portable. The housing 20 comprises an opening with the divider 30 that extends therethrough. The divider 30 may be formed of a material that allows it to roll onto a reel or other cylindrical member within the housing 20. In the retracted position, the divider 30 is rolled onto the cylindrical member within the housing 20 and the in the extended position, the divider 30 is extended through the opening of the housing 20 and retained in a vertical position. The divider 30 may be formed of a material that allows for this functionality or may include a structure that operates to hold flexible material in the vertical position. In embodiments, the assembly 10 is portable and a person may transport the assembly 10 by carrying it with him or her to the locations that the individual may wish to utilize a divider.

Figure 6A:
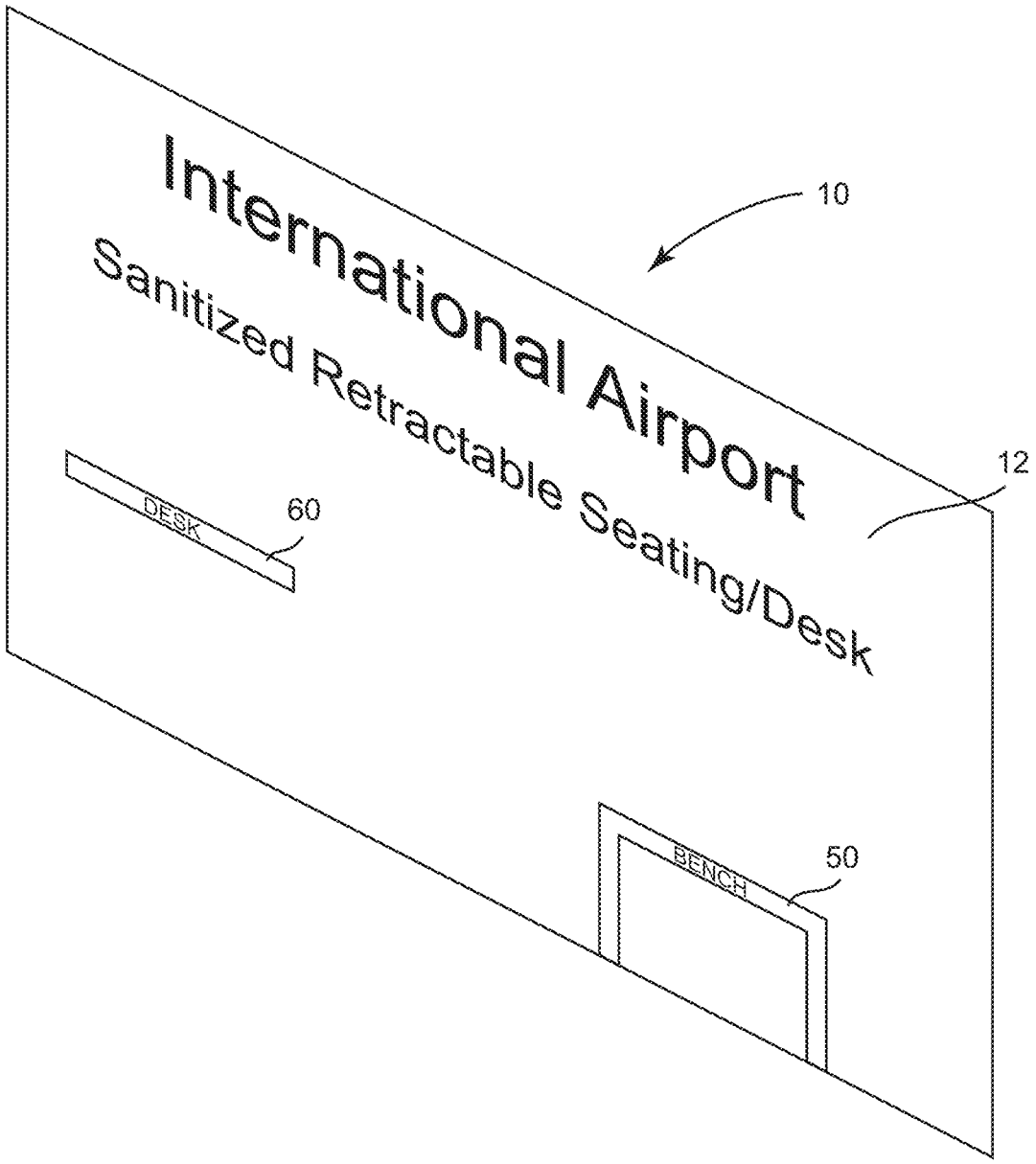
FIG. 6A is a view of a table with a retractable self-sanitizing seating and desk assemblies coupled thereto with the seating and table in a retracted position according to an embodiment.
Figure 6B:
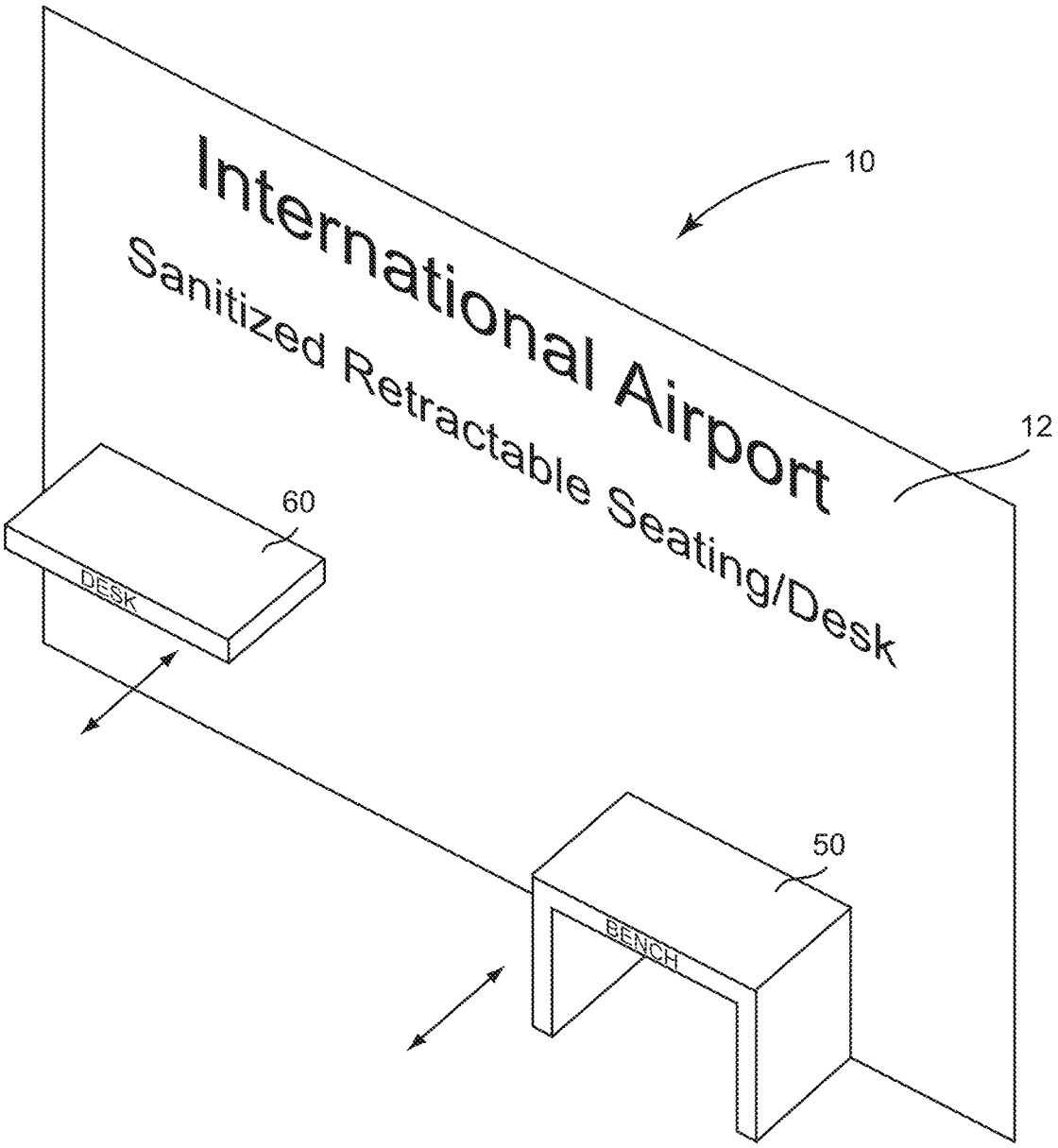
FIG. 6B is a view of a table with a retractable self-sanitizing seating and desk assemblies coupled thereto with the seating and table in an extended position according to an embodiment.

In some embodiments, the assembly 10 may be utilized for other structures beyond a divider 30. For example, as depicted in FIGS. 6A and 6B, the assembly 10 may operate for seating structures 50 and desk structures 60 that are moveable between retracted positions and extend positions from the planar structure 12 that is a wall at an airport for passengers waiting to board a plane. The operation is the same for these structures as it is for the divider, wherein the seating structures 50 and desk structures 60 may be moved between a retracted position (FIG. 6A) and an extended position (FIG. 6B), including the sanitization of the seating structures 50 and desk structures 60 when moving between the extended position and the retracted position.

Figure 8A:
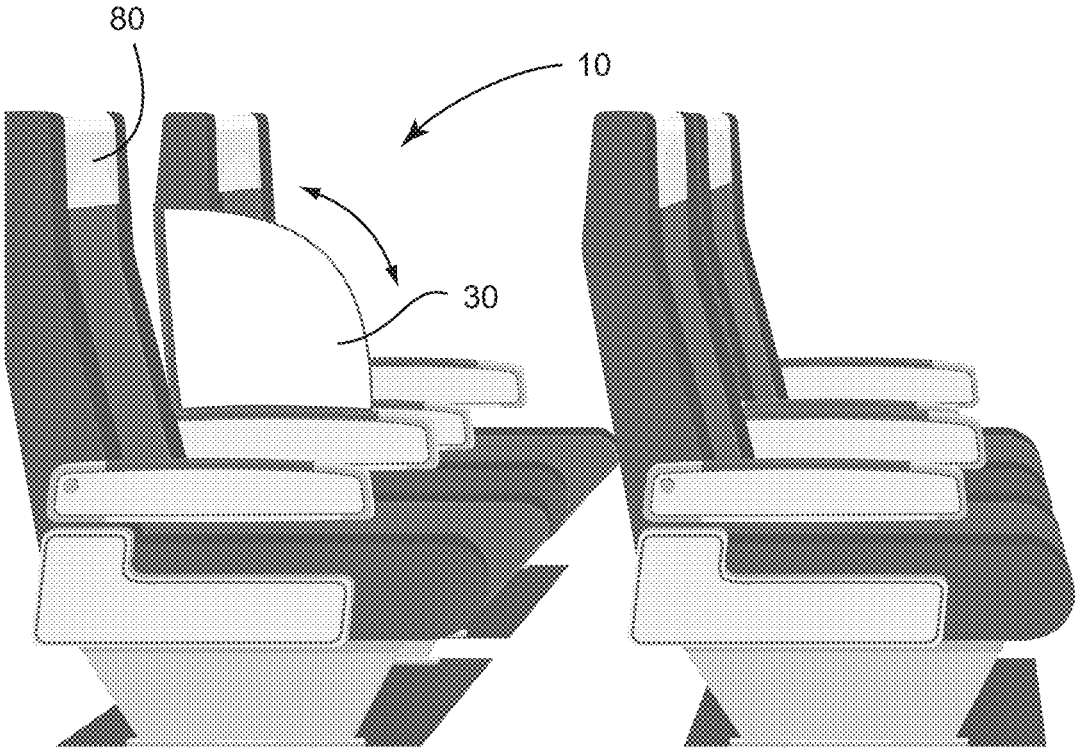
FIG. 8A is a view of seats with a retractable self-sanitizing divider assembly coupled thereto with the divider in an extend position according to an embodiment.
Figure 8B:
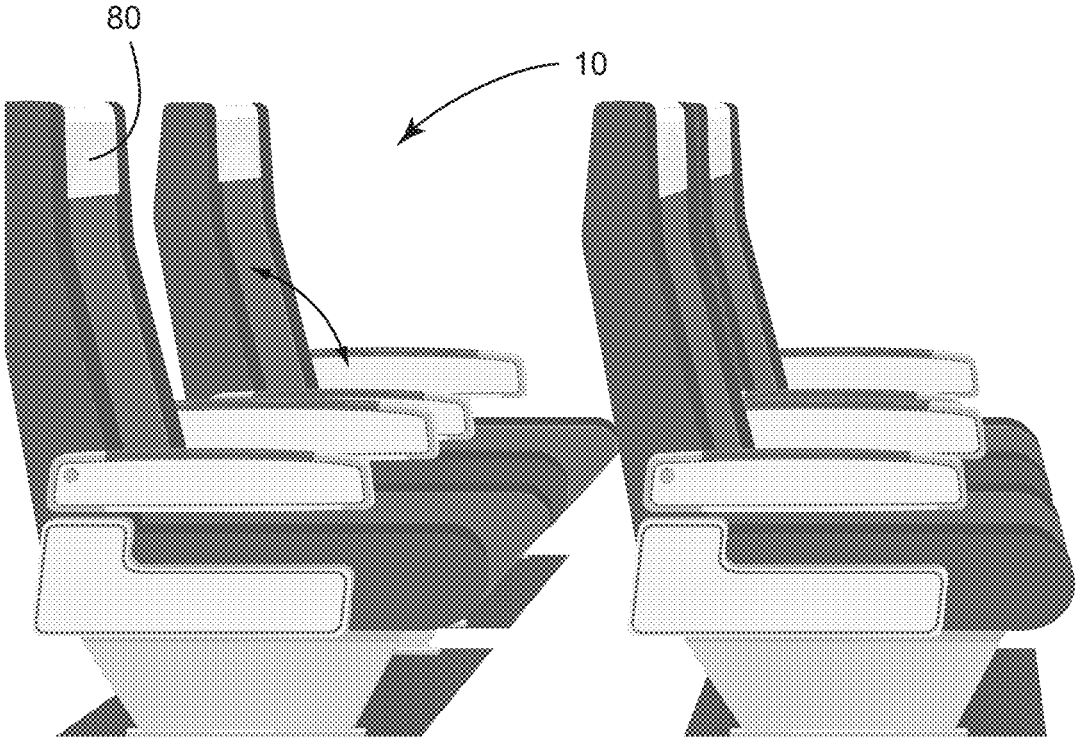
FIG. 8B is a view of seats with a retractable self-sanitizing divider assembly coupled thereto with the divider in a retracted position according to an embodiment.

Further still, as shown in FIGS. 8A-8B, the assembly 10 may be coupled to arm rests or otherwise between seats, such as seats 80 on airlines, buses, trains or other shared transportation, and further may be used between other venue seats, like theater seats, sporting event seats or the like. In these embodiments, the divider 30 may be a flexible material and the housing 20 may include an hinged member 24 hingedly coupled to the housing 20 on one end. The hinged member 24 may be coupled to an end of the divider 30 and the opposing end of the divider may be coupled to the housing 20. Rotation of the hinged member 24 away from the housing 20 results in moving the divider from the retracted position to the extended position, wherein the divider is a partial circular shape. The rotation of the hinged member 24 toward the housing 20 results in the divider being moved from the extended position to the retracted position with the divider 30 within the housing 20. These embodiments may be incorporated into the arm rests of the seats 80 or may be after market products coupled to the seats 80.

Figure 9A:
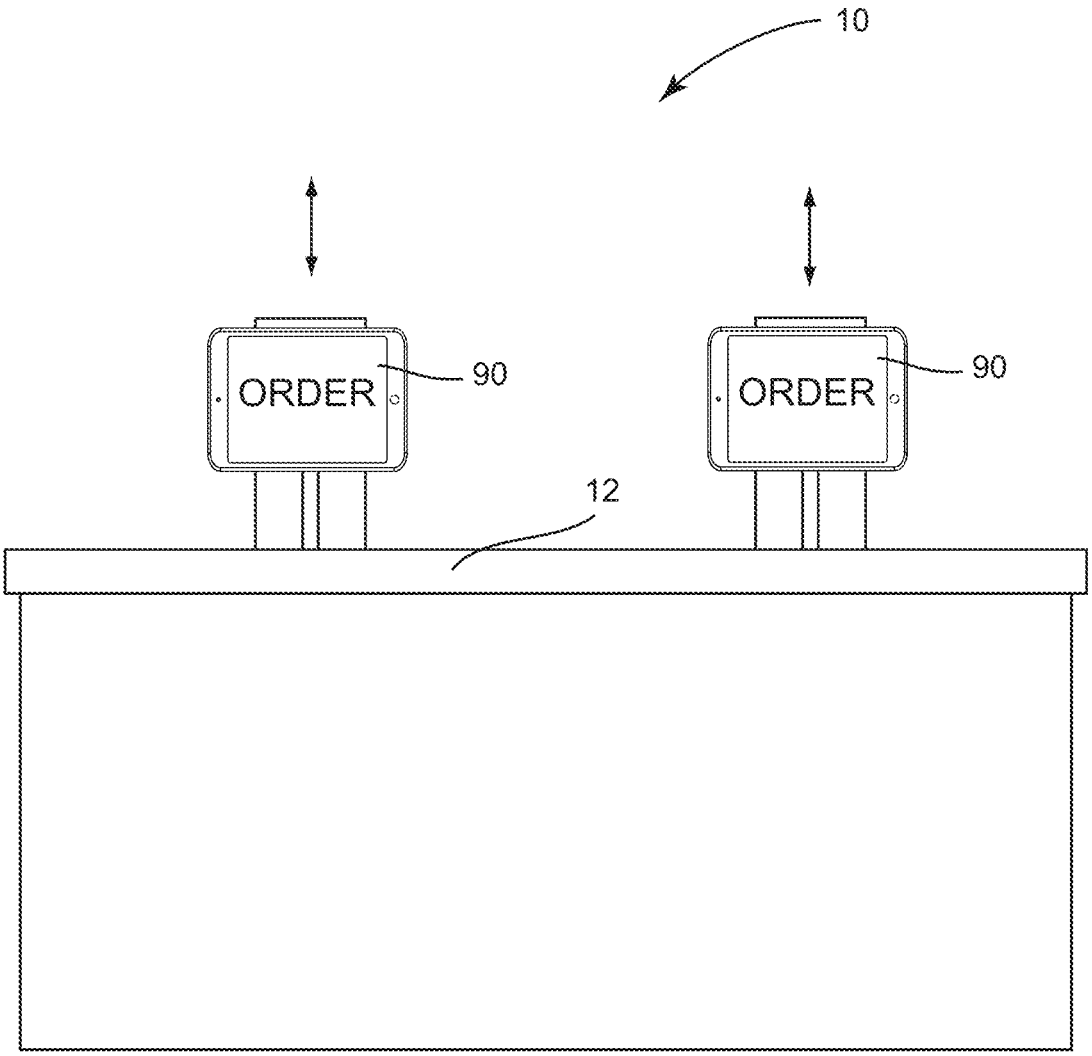
FIG. 9A is a view of a self-order kiosk with a retractable self-sanitizing order assembly coupled thereto with the order device in an extend position according to an embodiment.
Figure 9B:
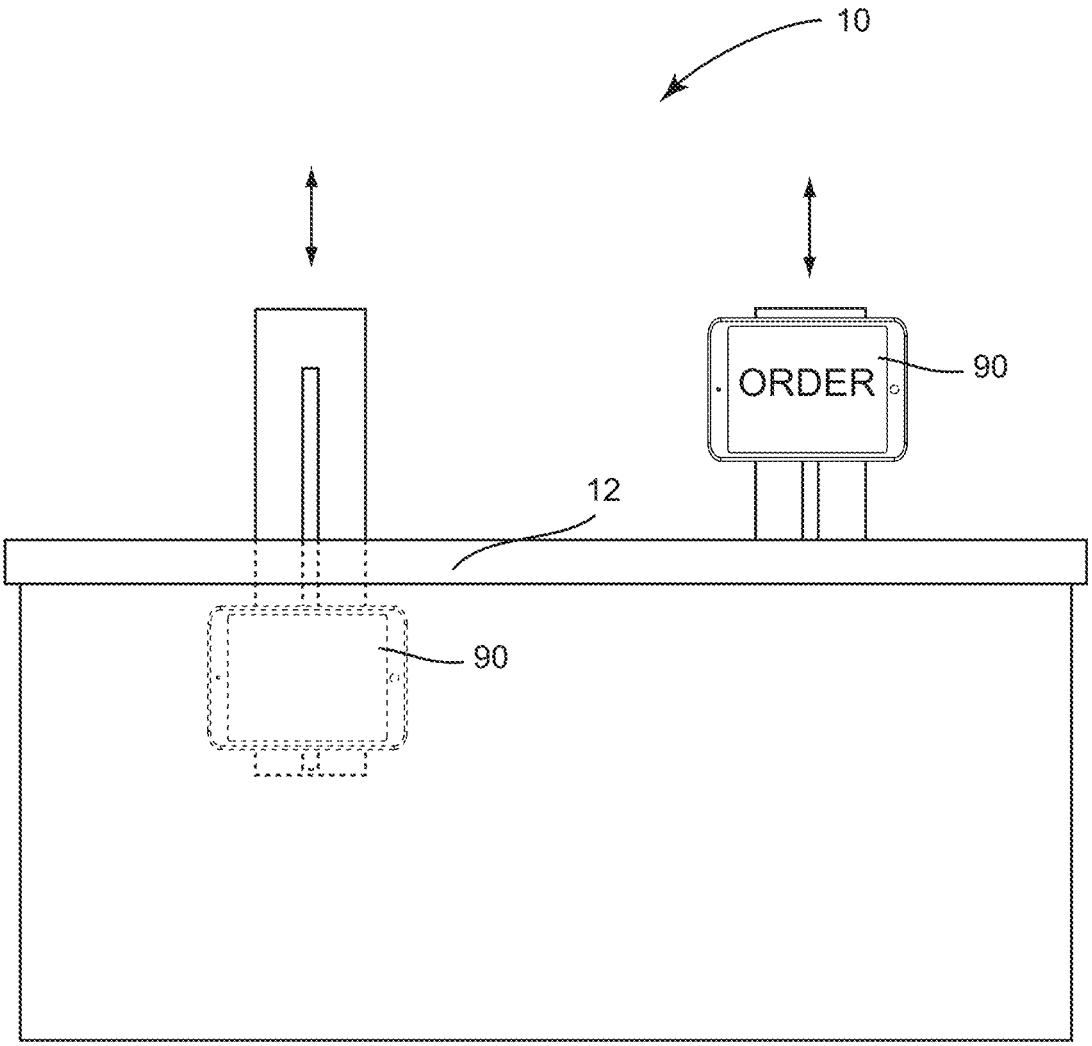
FIG. 9B is a view of a self-order kiosk with a retractable self-sanitizing order assembly coupled thereto with the order device in a retracted position according to an embodiment.

In additional embodiments, the assembly 10 may be utilized for other purposes and devices beyond a divider 30. For example, as depicted in FIGS. 9A and 9B, the assembly 10 may operate for order devices 90 that are moveable between retracted positions and extend positions from the planar structure 12 that is a flat surface of an order kiosk 92. The operation is the same for these order devices 90 as it is for the divider, wherein the order devices 90 may be moved between a retracted position (FIG. 9B) and an extended position (FIG. 9A), including the sanitization of the order device 90 when moving between the extended position and the retracted position. In embodiments, once an order is completed, the assembly 10 may automatically operate to move the device 90 from the extended position to the retracted position to be sanitized, and then the device may automatically be moved from the retracted position to the extended position to receive another order.

Embodiments may be available on or through the internet, such as through domain names reserved and owned by Applicant that include dipandclean.com, friendlydivider-.com, pushtoclean.com, cleanpopup.com, magicdivider.com and the like.

Accordingly, the components defining any retractable self-sanitizing divider assembly may be formed of any of many different types of materials or combinations thereof that can readily be formed into shaped objects provided that the components selected are consistent with the intended operation of a retractable self-sanitizing divider assembly. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any retractable self-sanitizing divider assembly may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A retractable self-sanitizing divider assembly comprising:

a planar structure comprising a first surface and a second surface;

a housing comprising an interior volume with an opening on one side of the housing providing access to the interior volume of the housing, wherein the housing is coupled to the planar structure;

a divider coupled within the housing moveable between a retracted position and an extended position, wherein in the retracted position the divider is located within the housing and in the extended position, a portion of the divider is extended through the opening of the housing to extend away from the first surface of the planar structure; and a sanitization system coupled to the housing wherein the sanitization system automatically sanitizes the divider during movement of the divider with sanitizing solution between the retracted position and the extended position.

2. The assembly of claim 1, wherein the divider is spring loaded.

3. The assembly of claim 1, wherein the divider is a manually moved between the retracted position and the extended position.

4. The assembly of claim 1, wherein the divider comprises an actuator that is electrically operated to move the divider between the retracted position and the extended position.

5. The assembly of claim 1, wherein the divider is a planar substrate.

6. The assembly of claim 1, wherein the housing is an open box shape.

7. The assembly of claim 1, wherein the sanitization system comprises a flexible substrate.

8. The assembly of claim 7, wherein the sanitizing solution is retained in the flexible substrate.

9. The assembly of claim 8, wherein the sanitizing solution is located adjacent the opening of the housing.

10. The assembly of claim 7, wherein the flexible substrate is coupled to a cassette.

11. The assembly of claim 10, wherein the cassette is removeably coupled to the housing.

12. The assembly of claim 10, wherein the cassette is removeably coupled to the divider.

13. The assembly of claim 7, wherein the sanitizing solution is incorporated into a spray device sprayed on the flexible substrate.

14. The assembly of claim 1, wherein the assembly is coupled between seats.

15. The assembly of claim 14, wherein the assembly is coupled to an armrest between the seats.

16. The assembly of claim 14, wherein the seats are shared transportation seats.

17. The assembly of claim 14, wherein the seats are venue seats.

* * * * *